US009826850B2

(12) United States Patent
Hasani

(10) Patent No.: US 9,826,850 B2
(45) Date of Patent: Nov. 28, 2017

(54) CUP SLEEVE WITH HINGED BOTTOM

(71) Applicant: Fisnik T. Hasani, Richmond, VA (US)

(72) Inventor: Fisnik T. Hasani, Richmond, VA (US)

( * ) Notice: Subject to any disclaimer, the term of this patent is extended or adjusted under 35 U.S.C. 154(b) by 0 days.

(21) Appl. No.: 15/186,530

(22) Filed: Jun. 19, 2016

(65) Prior Publication Data

US 2017/0042356 A1 Feb. 16, 2017

Related U.S. Application Data

(60) Provisional application No. 62/203,482, filed on Aug. 11, 2015.

(51) Int. Cl.
*A47G 23/02* (2006.01)
*B65D 81/38* (2006.01)

(52) U.S. Cl.
CPC ..... *A47G 23/0216* (2013.01); *B65D 81/3876* (2013.01)

(58) Field of Classification Search
CPC ..... A47G 23/0216; A47G 23/0208; A47G 23/02; B65D 81/3876; B65D 81/38
USPC ..... 220/737, 738, 739; 229/405
See application file for complete search history.

(56) References Cited

U.S. PATENT DOCUMENTS 1,917,953 A 7/1933 Davis
2,081,409 A 5/1937 Rush
2,263,122 A 11/1941 De Haven
3,379,335 A * 4/1968 Mongelluzzo ..... B65F 1/02 220/62
5,169,025 A 12/1992 Guo
5,445,315 A 8/1995 Shelby
6,026,983 A 2/2000 Graham
6,152,363 A 11/2000 Rule, Jr.
6,412,686 B1 7/2002 Mahl et al.
6,464,100 B2 10/2002 Canfield
2006/0283868 A1 12/2006 McDonald, II
2007/0138188 A1 6/2007 Mace et al.
2014/0151385 A1 6/2014 Chun

OTHER PUBLICATIONS

International Search Report and Written Opinion for Appl. No. PCT/US2016/043822, dated Oct. 20, 2016, 7 pages.

* cited by examiner

*Primary Examiner* — Robert J Hicks
(74) *Attorney, Agent, or Firm* — Patent Law of Virginia, PLLC; Brian J. Teague

(57) ABSTRACT

A sleeve for a beverage cup comprises a main wall and bottom hingedly attached to a bottom edge of the main wall. The main wall has an open top end and a bottom end. The main wall defines a central cavity for receiving at least a portion of a beverage cup inserted into the central cavity via the open top end. The bottom comprises a circular floor portion and a plurality of fingers projecting radially from the floor portion. When the sleeve is in a deployed position for use, the floor portion is substantially perpendicular to a longitudinal axis of the sleeve and closes off the bottom end of the main wall, the fingers are bent upward relative to the floor portion, and the fingers are in contact with an inner surface of the main wall.

9 Claims, 5 Drawing Sheets

10
12
B

DETAIL B
SCALE 3 : 1

12
A
16

DETAIL A
SCALE 2 : 1
14
18

16
18
12
14
12
10

10
12

16
18
10
14
12

12
14
10

10
12
FOLD FOR BOTTOM
16
14
DETAIL A
SCALE 2:1

10
12
14
SECTION A-A
SCALE 0.6 : 1

10

12
10
14
SECTION B-B
12
10
14

12
10
14
SECTION D-D

10

14
SECTION C-C
12
12
A
A
C
C
D
D

10
B
B
12
14

40

40
ABSORBENT PAD 32
30
34
38
40
SECTION A-A 40
32
36
30

30
32
36
A
A

CUP SLEEVE WITH HINGED BOTTOM

CROSS-REFERENCE TO RELATED APPLICATIONS

This application claims priority to U.S. Provisional Application Ser. No. 62/203,482, filed Aug. 11, 2015, the contents of which are incorporated herein by reference in its entirety.

FIELD OF THE INVENTION

The present invention relates generally to field of food and beverage supplies, and specifically to disposable sleeves used for holding beverage cups.

BACKGROUND OF THE INVENTION

It is known to provide single-use sleeves (typically constructed of cardboard or paper) to thermally protect a consumer's hand from the heat of a hot drink (e.g., coffee), which is often served in a thin cardboard or paper cup. Such hot cup sleeves are produced and procured in very large quantities, are mass-produced, and are meant to be disposable after one use.

Such hot cup sleeves do not work well for cold drinks. Condensation typically forms on the outer surface of a cup containing a cold drink, especially during the summer when such cold drinks are more commonly consumed. The condensed moisture drips down the cup and pools onto whatever surface the cup is on, such as a tabletop or a vehicle drink holder, creating a messy situation. The condensed moisture may also fall on the clothing items of the person holding the cup while sitting down or while walking with the cup in hand.

BRIEF SUMMARY OF THE DISCLOSURE

In one embodiment of the invention, a sleeve for a beverage cup comprises a main wall and bottom hingedly attached to a bottom edge of the main wall. The main wall has an open top end and a bottom end. The main wall defines a central cavity for receiving at least a portion of a beverage cup inserted into the central cavity via the open top end. The bottom comprises a circular floor portion and a plurality of fingers projecting radially from the floor portion. When the sleeve is in a deployed position for use, the floor portion is substantially perpendicular to a longitudinal axis of the sleeve and closes off the bottom end of the main wall, the fingers are bent upward relative to the floor portion, and the fingers are in contact with an inner surface of the main wall.

The main wall may have an inverted truncated conical shape.

Each of the plurality of fingers may have opposing side edges that are angled inward from a proximal end to a distal end of each respective finger. Each of the plurality of fingers may have a trapezoidal shape. Each of the plurality of fingers may have a triangular shape.

The bottom may be integral with the main wall. The bottom may be adhesively affixed to the main wall.

The bottom may further comprise an absorbent pad.

The sleeve may be movable between a flat position and the deployed position. When the sleeve is in the flat position, the main wall is flattened such that opposing sides of the main wall are in contact with each other, the bottom is positioned between the opposing sides of the main wall and is in contact with the inner surface of the main wall, and the fingers are coplanar with the floor portion.

In addition to the sleeve for a beverage cup, as described above, other aspects of the present invention are directed to corresponding methods of manufacturing and using such a sleeve for a beverage cup.

BRIEF DESCRIPTION OF THE SEVERAL VIEWS OF THE DRAWINGS

The foregoing summary, as well as the following detailed description of the disclosure, will be better understood when read in conjunction with the appended drawings. For the purpose of illustrating the disclosure, there are shown in the drawings embodiments which are presently preferred. It should be understood, however, that the disclosure is not limited to the precise arrangements and instrumentalities shown. In the drawings.

DETAILED DESCRIPTION OF THE DISCLOSURE

Figures 1A, 1B, 1C, 1D:
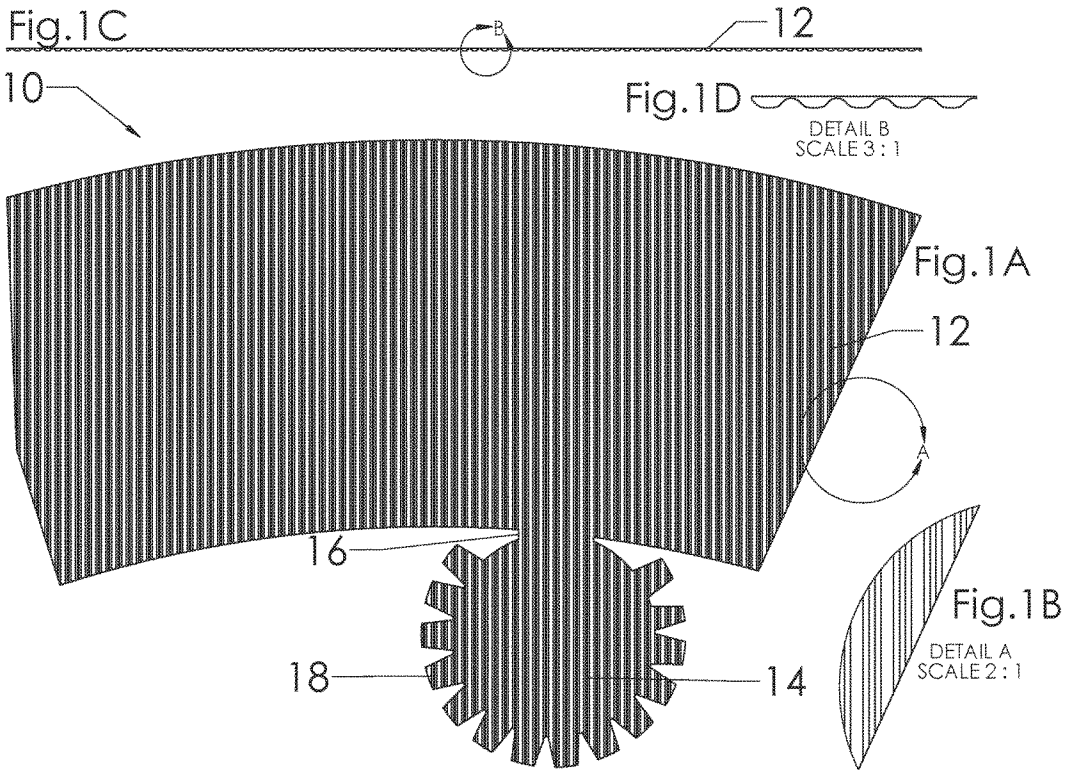
FIGS. 1A-D illustrate a cup sleeve in an unassembled state, in accordance with embodiments of the present invention.

Certain terminology is used in the following description for convenience only and is not limiting. The words "lower," "bottom," "upper," and "top" designate directions in the drawings to which reference is made. The words "inwardly," "outwardly," "upwardly" and "downwardly" refer to directions toward and away from, respectively, the geometric center of the device, and designated parts thereof, in accordance with the present disclosure. Unless specifically set forth herein, the terms "a," "an" and "the" are not limited to one element, but instead should be read as meaning "at least one." The terminology includes the words noted above, derivatives thereof and words of similar import.

Embodiments of the invention are directed to cup sleeves that may be used with a cold drink to help contain the moisture that condenses on the cup. Embodiments of the invention may be for single use only, and may be readily and relatively inexpensively produced in bulk. As with conventional cup sleeves, a cup sleeve of embodiments of the invention may be cut or stamped from flat paper or cardboard stock (including laminated materials, such as flat and corrugated cardboard laminated together), folded and glued together, transported and stored flat, and opened up for use.

FIGS. 1A-D illustrate a cup sleeve in an unassembled state, in accordance with embodiments of the present invention. FIG. 1A is a face view; FIG. 1B is a close-up view of a portion of FIG. 1A; FIG. 1C is an edge view; and FIG. 1D is a close-up view of a portion of FIG. 1C. It is the shape illustrated in FIGS. 1A-D (and variations thereof) that is readily cut or stamped from flat paper or cardboard stock for mass production. As seen in FIG. 1A, cup sleeve 10 comprises a generally arcuate (when unassembled) main body 12. Main body 12 is similar to the entirety of a conventional cup sleeve, in that the opposing ends of main body 12 may be affixed (e.g., glued) to each other to form an inverted truncated hollow cone that fits around a cup. However, cup sleeve 10 advantageously has a bottom portion 14 affixed to the main body 12 at hinge point 16 along the bottom edge of the main body 12. (Bottom portion 14 is integral with main body 12.) A plurality of radial fingers 18 extend from the periphery of the bottom portion 14. The fingers 18 have a generally trapezoidal shape with a flat distal end, although other shapes may be used (e.g., triangular with a pointed distal end, square, or rectangular). The angled sides of the trapezoidal-shaped fingers enable the fingers to fold upward into the desired position when the cup sleeve is opened for use (described further below), without the fingers interfering with each other. If desired, the base of each finger (i.e., the point at which it bends in relation to the rest of the bottom portion) may be pre-creased, crimped, perforated, or otherwise weakened to more easily enable the fingers to fold upward into the desired position when the cup sleeve is opened for use.

The fingers may extend from most of the periphery of the bottom portion 14, as seen in FIG. 1A. The fingers may extend from less of the periphery than is illustrated in FIG. 1A, however this may not be desirable as the contact between the fingers and the main body when assembled and opened for use (as described below) helps maintain the bottom portion in the desired opened position (having fewer fingers may not maintain the position of the bottom portion as well). The fingers likely will not extend from more of the periphery than is illustrated in FIG. 1A, as it would be difficult to provide fingers closer to the main body than is illustrated in FIG. 1A as there is not sufficient material from which to cut any additional fingers. The fingers may be spaced further apart than is illustrated in FIG. 1A, however this may not be desirable as the contact between the fingers and the main body when assembled and opened for use (as described below) helps maintain the bottom portion in the desired opened position (having spaced-apart fingers may not maintain the position of the bottom portion as well).

The cup sleeve of embodiments of the invention may be constructed out of any suitable material, typically paperboard or corrugated cardboard (two or three ply). Paperboard is a flat, single ply thick paper stock. Corrugated cardboard may comprise two plies or layers (namely a fluted layer affixed to a flat layer), or may comprise three plies or layers (namely a fluted layer sandwiched between and affixed to opposing flat layers). FIGS. 1A-D illustrate use of two ply corrugated cardboard, with the flat layer being the outer layer of the cup sleeve when assembled and the corrugated layer being the inner layer of the cup sleeve when assembled. In one embodiment of the invention, the cup sleeve of embodiments of the invention is constructed out of E-flute singleface sheets (which is a common term used in the paper industry) in which the flat layer comprises 42 or 26 pound paper stock and the corrugated layer comprises 26 pound paper stock with E-type (1.5 mm) fluting.

The use of a corrugated material provides strength as well as providing a plurality of thermally insulating air spaces between the interior wall of the cup sleeve and the exterior wall of the cup. However, it should be understood that other suitable materials, such as other forms of paper, various plastics, foams, fabrics, and other materials capable of being die-cut and folded into the desired shape may also be used. The cup sleeve of embodiments of the invention may be imprinted or embossed with advertising material, graphics, and the like, such that the material is displayed on the exterior wall when the cup sleeve is assembled.

The corrugated side of the cup sleeve, which is facing up in FIG. 1A, is the interior side of the cup sleeve when assembled.

Figures 2A, 2B, 2C, 2D, 2E, 2F:
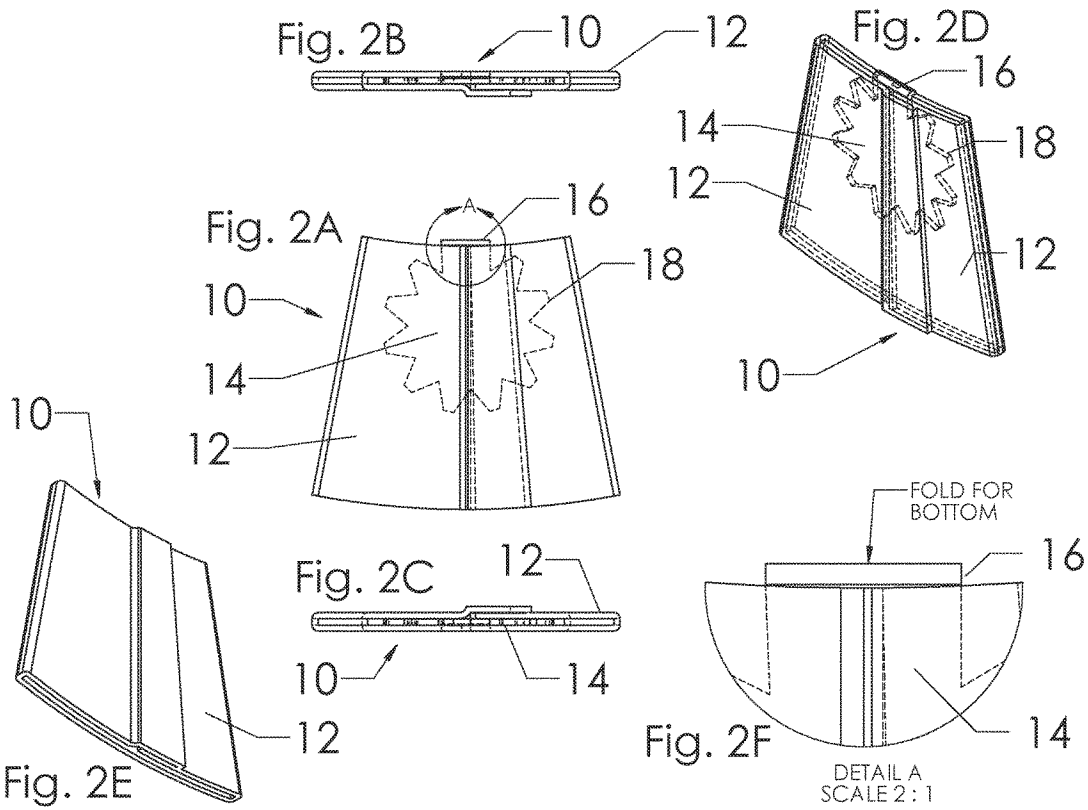
FIGS. 2A-F illustrate the cup sleeve of FIGS. 1A-D, in an assembled and flattened state for storage and transport.

FIGS. 2A-F illustrate the cup sleeve of FIGS. 1A-D, in an assembled and flattened state for storage and transport. FIG. 2A is a face view; FIG. 2B is a bottom edge view; FIG. 2C is a top edge view; FIG. 2D is a perspective view showing hidden portions in dashed lines; FIG. 2E is a perspective view; and FIG. 2F is a close-up view of a portion of FIG. 2A. To assemble the cup sleeve from the unassembled state shown in FIGS. 1A-D, with the corrugated side face up, the bottom portion 14 is folded at hinge point 16 until the bottom portion 14 sits flat against the main body 12. A first one of the opposing ends of the main body 12 is folded toward the center of the main body and flattened against the main body, such that a crease is formed. An adhesive is applied to that first end (to the side that had been face down but is now face up). A second one of the opposing ends of the main body 12 is folded toward the center of the main body and flattened against the main body, such that a crease is formed, such that the second end overlaps the first end and, such that the adhesive affixes the two ends together. The adhesive is allowed to dry or cure. The cup sleeve 10 is now in an assembled and flattened state for storage and transport, as seen in FIGS. 2A-E.

Figures 3A, 3B, 3C, 3D, 3E, 3F, 3G, 3H:
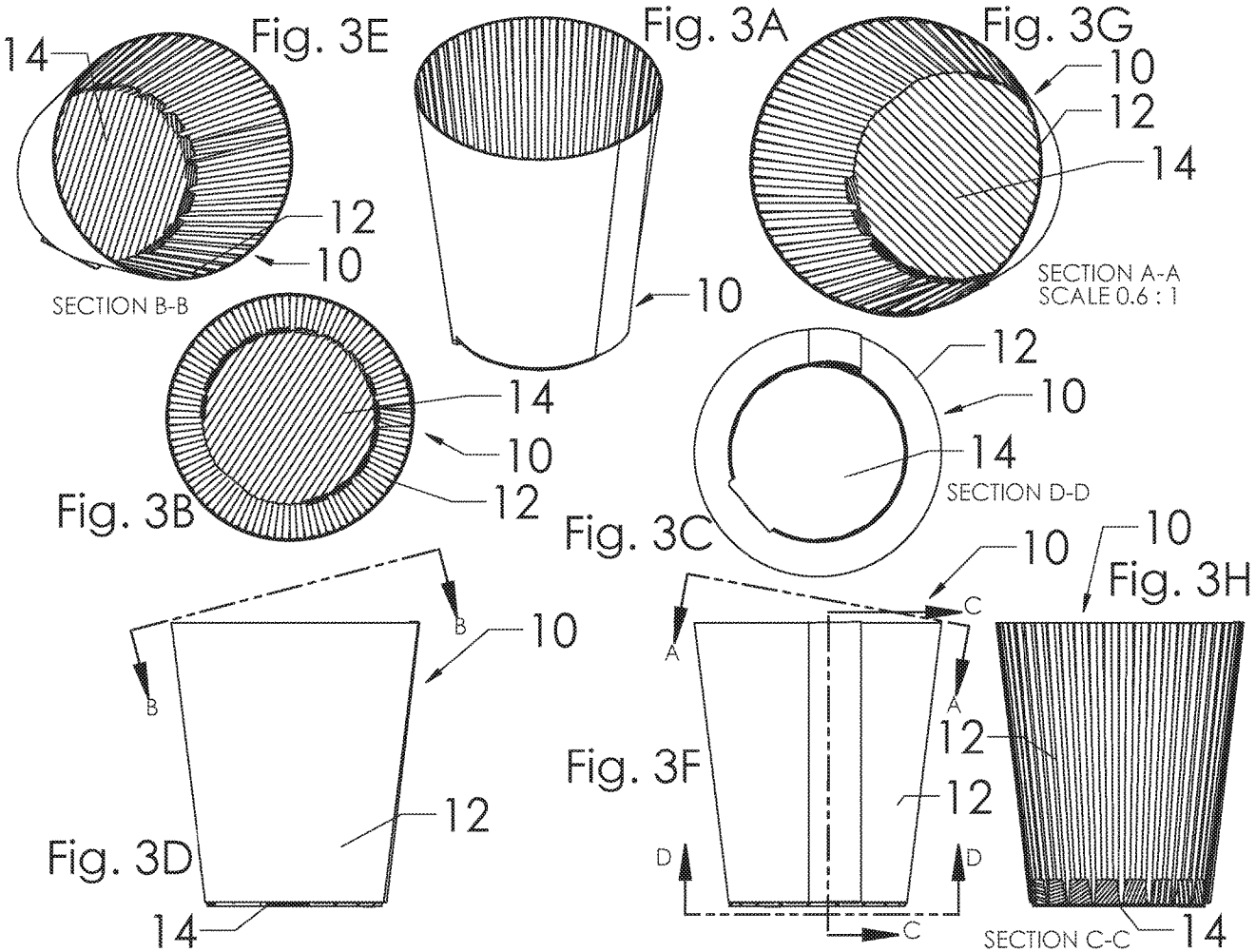
FIGS. 3A-H illustrate the cup sleeve of FIGS. 1A-D, in an assembled and opened state for use.

FIGS. 3A-H illustrate the cup sleeve of FIGS. 1A-D, in an assembled and opened state for use. FIG. 3A is a perspective view; FIG. 3B is a top view; FIG. 3C is a bottom view; FIG. 3D is a side view; FIG. 3E is a top perspective view; FIG. 3F is a side view opposite FIG. 3D; FIG. 3G is a top perspective view from a different angle than FIG. 3E; and FIG. 3H is a sectional view along line C-C. When ready to use the cup sleeve of embodiments of the invention, the opposing creased sides of the flattened sleeve of FIGS. 2A-E are grasped and squeezed together. This squeezing together opens the main body 12 to receive a cup and causes the bottom portion 14 to unfold away from the main body and downward toward the bottom opening of the main body. As the bottom portion 14 unfolds away from the main body and downward toward the bottom opening of the main body, the fingers contact the interior wall of the main body, thereby forcing the fingers to fold upward as the bottom portion unfolds downward. The squeezing together alone may not provide sufficient force to cause the bottom to fully unfold (when fully unfolded, the bottom 14 is substantially perpendicular to a longitudinal axis of the sleeve 10 and closes off the bottom end) and the fingers to fully fold upward. Insertion of a cup into the cup sleeve 10 may be necessary to provide the additional force needed to cause the bottom 14 to fully unfold and the fingers 18 to fully fold upward. Insertion of a cup pushes downward on the bottom 14 (if the bottom is not already fully unfolded) to cause the bottom to fully unfold and the fingers to fully fold upward. The angled sides of the trapezoidal-shaped fingers enable the fingers to fold upward into the desired position when the cup sleeve is opened for use, without the fingers interfering with each other.

When in its fully unfolded position (seen in FIGS. 3A-H), the bottom portion 14 fills the bottom opening of the main body 12 and the fingers 18 sit against the interior wall of the main body. In this regard, the bottom portion 14 thereby closes off the bottom end of the cup sleeve. When in use, bottom portion 14 sits below the bottom of a cup (typically although not necessarily in contact with the bottom of the cup) to help contain any condensation that drips down the outer surface of the cup. The bottom portion 14 may also help hold the cup sleeve 10 in its opened state, as seen in FIG. 3.

Figures 4A, 4B, 4C, 4D, 4E:
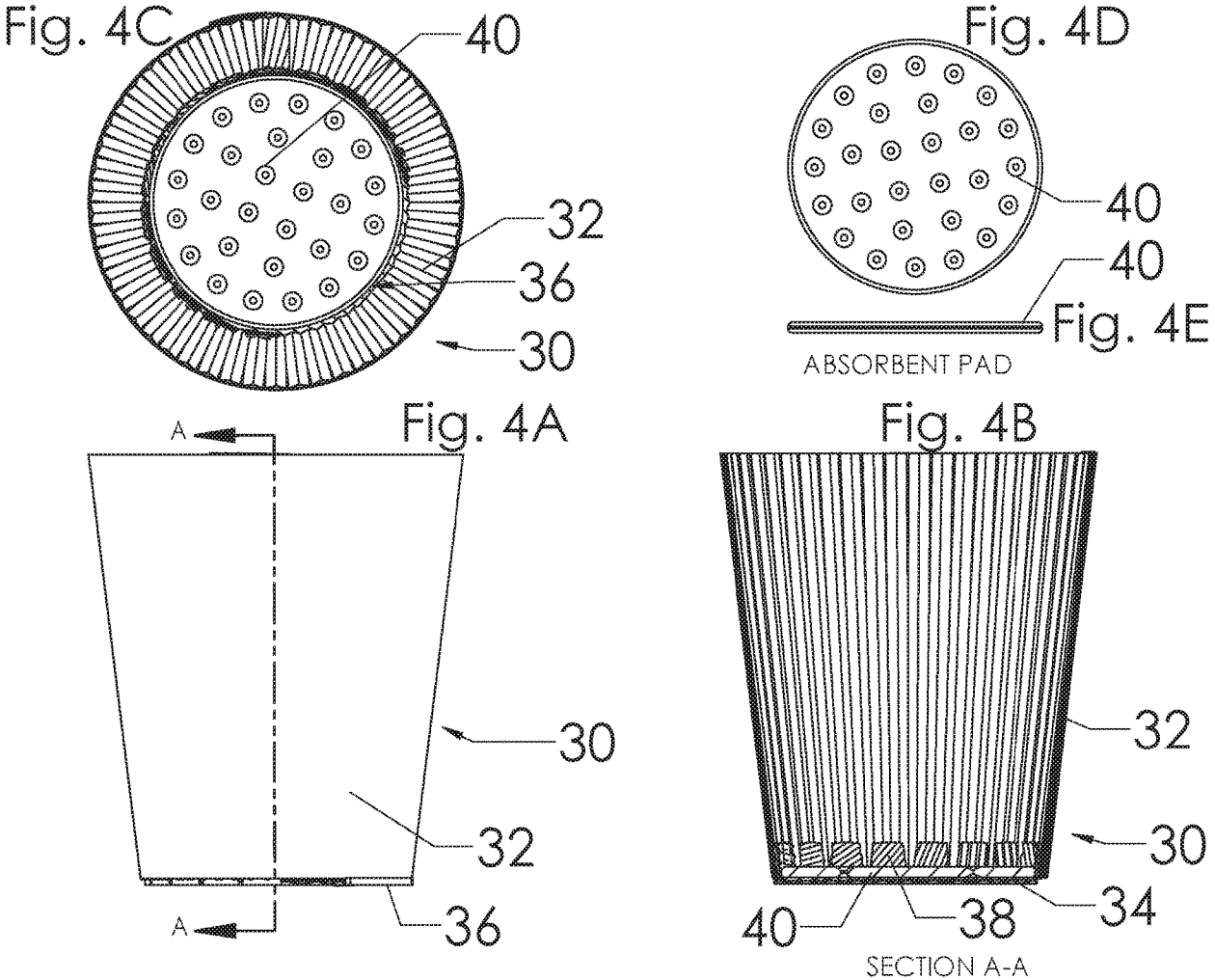
FIGS. 4A-E illustrate a cup sleeve, in accordance with alternative embodiments of the present invention.

FIGS. 4A-E illustrate a cup sleeve in an assembled and opened state for use, in accordance with alternative embodiments of the present invention. FIG. 4A is a side view; FIG. 4B is a cross-sectional side view along line A-A; FIG. 4C is a top view; FIG. 4D is a top view of the absorbent pad removed from the sleeve; and FIG. 4E is a side view of the absorbent pad removed from the sleeve. Cup sleeve 30 is nearly identical to cup sleeve 10, in that cup sleeve 30 comprises a main body 32, a bottom portion 34 affixed to the main body 32 at hinge point 36, and fingers 38. Additionally, cup sleeve 30 comprises an absorbent pad 40 affixed to the bottom portion 34. Absorbent pad 40 is affixed to the corrugated side of bottom portion 34 such that the absorbent pad is on the inside surface when the cup sleeve is assembled and opened for use. The absorbent pad 40 helps catch and contain more condensation than would be possible using the cup sleeve 10 without the absorbent pad. The absorbent pad may be constructed of any suitable absorbent material or combination of materials, and may be affixed to the bottom portion using any suitable adhesive or other means. In one embodiment of the invention, the absorbent pad has a structure similar to a coffee pod, in that comprises two layers of coffee filter-type material, sealed around the perimeter, with an absorbent material (e.g., tissue paper) sandwiched between the two layers of coffee filter-type material.

Figure 5A:
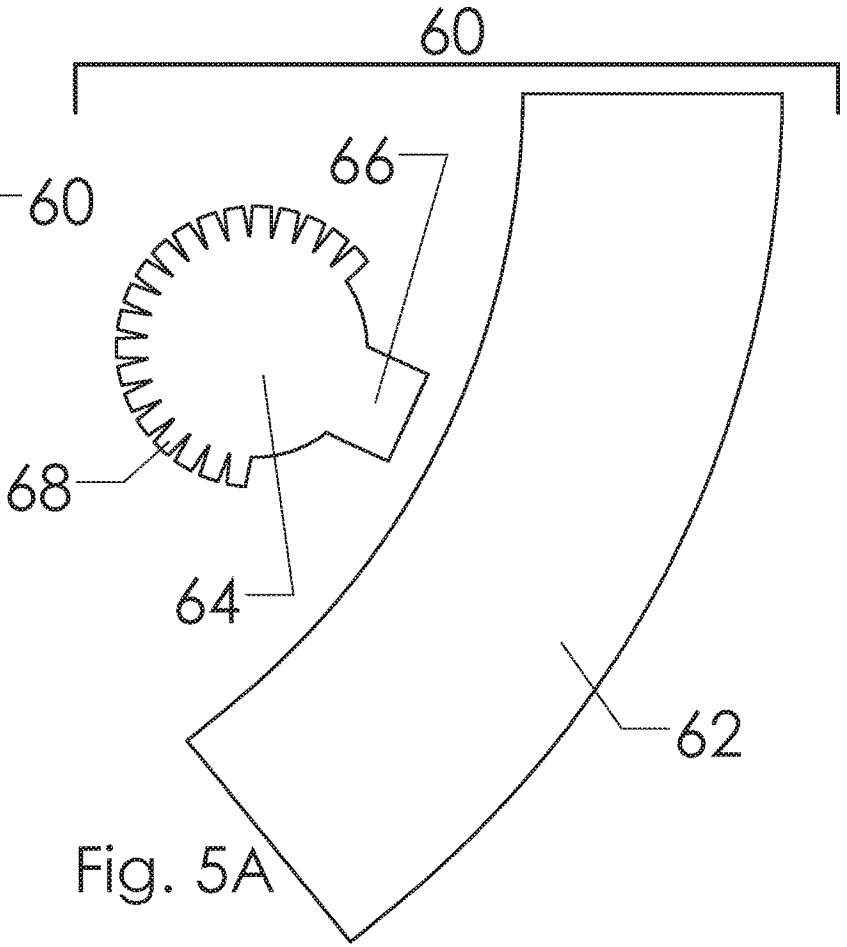
FIGS. 5A-B illustrate a cup sleeve, in accordance with alternative embodiments of the present invention.
Figure 5B:
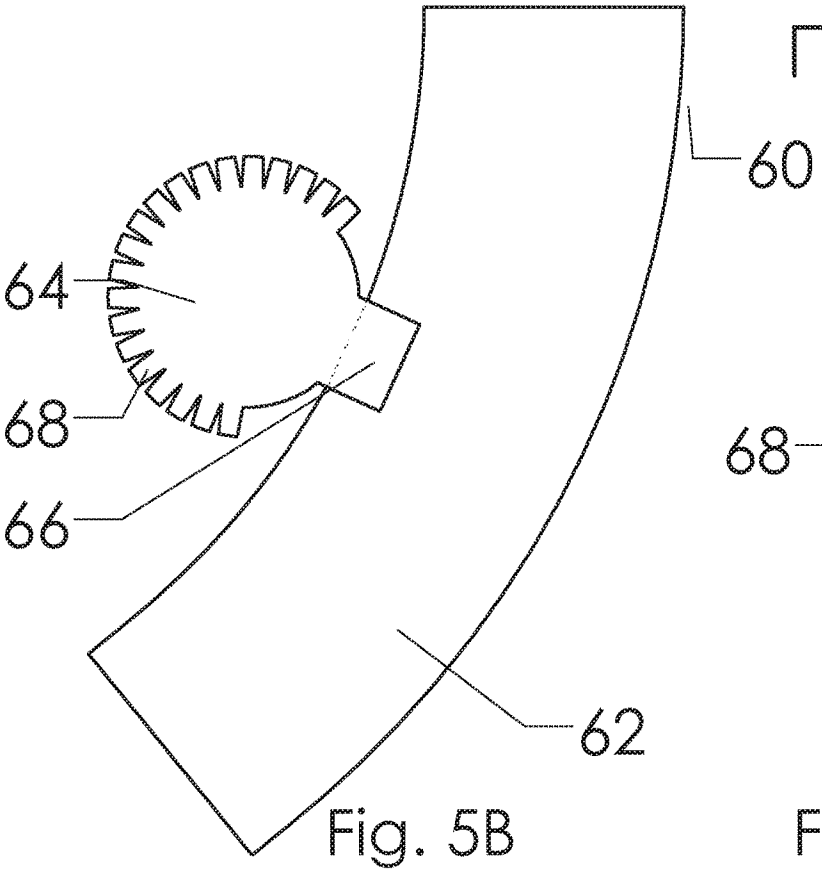

FIGS. 5A-B illustrate a cup sleeve in an unassembled state, in accordance with alternative embodiments of the present invention. Cup sleeve 60 is nearly identical to cup sleeve 10, in that cup sleeve 60 comprises a main body 62, a bottom portion 64 affixed to the main body 62, and fingers 68. However, cup sleeve 60 differs from cup sleeve 10 in that bottom portion 64 is constructed (typically die-cut) separately from main body 62 and then affixed (typically with any suitable adhesive) to main body 62 via tab 66.

The shape and dimensions (e.g., height, diameter at top, diameter at bottom, angle of main body, etc.) of cup sleeves of embodiments of the invention may vary, depending on, e.g., the size and shape of the cup with which the cup sleeve is to be used. In one exemplary embodiment of the invention, the height of the cup sleeve is about 4.5 inches, the diameter of the top opening is about 3.25 inches, and the diameter of the bottom opening is about 2.5 inches. Embodiments of the invention may be used with any type of drinking vessel, such as glasses or plastic cups.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

That which is claimed:

1. A sleeve for a beverage cup, the sleeve comprising:

a main wall having an open top end and a bottom end, the main wall defining a central cavity for receiving at least a portion of a beverage cup inserted into the central cavity via the open top end; and a bottom hingedly attached to a bottom edge of the main wall, the bottom comprising a circular floor portion and a plurality of fingers projecting radially from the floor portion;

wherein the sleeve is movable between a flat position and a deployed position;

wherein, when the sleeve is in the flat position, the main wall is flattened such that opposing sides of the main wall are at least partially in contact with each other, the floor portion and fingers are positioned between the opposing sides of the main wall and are in contact with the inner surface of the main wall, and the fingers are coplanar with the floor portion; and wherein, when the sleeve is in the deployed position for use, the floor portion is substantially perpendicular to a longitudinal axis of the sleeve and closes off the bottom end of the main wall, the fingers are bent upward relative to the floor portion, and the fingers are in contact with an inner surface of the main wall.

2. The sleeve of claim 1, wherein the main wall has an inverted truncated conical shape.

3. The sleeve of claim 1, wherein each of the plurality of fingers have opposing side edges that are angled inward from a proximal end to a distal end of each respective finger.

4. The sleeve of claim 1, wherein each of the plurality of fingers have a trapezoidal shape.

5. The sleeve of claim 1, wherein each of the plurality of fingers have a triangular shape.

6. The sleeve of claim 1, wherein the bottom is integral with the main wall.

7. The sleeve of claim 1, wherein the bottom is adhesively affixed to the main wall.

8. The sleeve of claim 1, wherein the bottom further comprises an absorbent pad.

9. The sleeve of claim 1, wherein, when the sleeve is moved between the flat position and the deployed position, the bottom moves away from the inner surface of the main wall and downward toward the bottom end and the fingers bend upward.

* * * * *